United States Patent [19]

Minervini

[11] Patent Number: 5,031,782

[45] Date of Patent: Jul. 16, 1991

[54] VERTICAL FILING SYSTEM

[76] Inventor: Raymond R. Minervini, 14909 Toepfer, East Detroit, Mich. 48021

[21] Appl. No.: 518,899

[22] Filed: May 4, 1990

[51] Int. Cl.[5] ..... A47F 5/00

[52] U.S. Cl. ..... 211/46; 40/375; 211/94; 211/162; 312/184

[58] Field of Search ..... 211/40, 41, 94, 94.5, 211/162, 45, 46; 40/375; 312/184

[56] References Cited

U.S. PATENT DOCUMENTS

| | | | |
|---|---|---|---|
| 4,585,127 | 4/1986 | Benedict | 211/94 X |
| 4,666,047 | 5/1987 | Fletcher | 211/162 X |
| 4,674,637 | 6/1987 | Lovelock et al. | 211/46 |
| 4,721,211 | 1/1988 | Lundberg | 211/46 |
| 4,730,736 | 3/1988 | Lindquist et al. | 211/46 |
| 4,907,706 | 3/1990 | Henderson | 211/94 X |

*Primary Examiner*—Robert W. Gibson, Jr.
*Attorney, Agent, or Firm*—Dykema Gossett

[57] ABSTRACT

The present invention relates to a holding assembly for holding sheets of material, as for example blueprints, in a vertical or hanging position and for providing an easy way to transport the sheet material when it is to be used. The assembly has a clip means normally open along its longitudinal extent. This clip opening can be enlarged by urging the walls of the clip outwardly. A retaining tube is provided which is open along its longitudinal extent and is adapted to receive the clip and engage the walls of the clip to both and to squeeze the walls of the clip against the sheet material. A mounting tube is provided which is also open along its longitudinal extent and is adapted to receive the clip and retaining tube. The mounting tube is mounted to a support rack so that the sheet material can hang vertically.

19 Claims, 1 Drawing Sheet

VERTICAL FILING SYSTEM

BACKGROUND OF THE INVENTION

The present invention relates to vertical filing systems and more particularly to an improved vertical filing system which is easy to manufacture, inexpensive, and versatile in its use as a storage system as well as a transportation system.

Typical vertical files include a retaining device attached to sheet material and a frame. Examples of vertical files are shown in U.S. Pat. Nos. 1,135,310 and 1,165,108 issued to Memmler, U.S. Pat. No. 1,911,277 issued to Helmer, U.S. Pat. No. 3,298,374 issued to Grundell, and U.S. Pat. No. 4,658,966 issued to Broek. Each of these patents shows a different method of holding large sheets of material, such as blueprints, newspapers, maps, etc. in a vertical filing arrangement.

The Memmler U.S. Pat. Nos. 1,135,310 and 1,165,108, are track systems which use binder clips to hold the sheet material. The binder clips, shown in FIGS. 3 and 4, are opened by manually squeezing ears 21 together to open clamping portion 17. Material is inserted into the clamping portions such that the free edges of the clamping portions engage the sheet material to hold it in place. The binder clip has grooves 15 to receive and engage inwardly extending flanges 11 on guides 10. Guides 10 are mounted to a carrier frame shown generally at 8. In this way, the sheet material can be clamped by the binder clamp and then slid onto and off of the carrier frame.

Helmer U.S. Pat. No. 1,911,277, uses a manual tensioning means to further enhance the biasing of the binder clip. The clip is fairly complex and includes a cam to enhance its gripping action. The cam is adjusted by nut 25. The clip is received within rails 34 which accommodate a conical section 38 at the top of the clips.

A further type of system is taught by U.S. Pat. No. 4,658,966 which employs a clip that utilizes a binder strip 31 having sides 41 and 42 which resiliently bias tightly against one another to clampingly retain sheets of material. Strip 31 can be used in conjunction with coupling means 112 as shown in FIGS. 4 and 5 to hang groups of sheet material. The binder strip 31 has means for mounting it to a laterally extending rod 27 and pins 79.

U.S. Pat. No. 3,298,374 shows a still further type of vertical filing system which uses button-type fasteners 11 which pass through holes in the flanges 9 as well as through the papers 10. The flange 9 is mounted within a channel bar member 1 which is in turn mounted to a support frame.

Each of the above vertical filing systems has disadvantages. The binder clip type are costly to manufacture and rely upon the bias of the binder clip to ensure proper retention. As the biasing force is increased to ensure greater retention, the difficulty in opening the binder clip increases proportionately.

The mechanical spring type is complicated in its construction and expensive to manufacture. It overcomes the disadvantage of the binder clip type but at greater expense. Also, the mechanical spring adjustment type does not permit the sheets of material to be easily rolled upon the mounting clip which could be done by the unit disclosed in the Memmler patents, '108 and '310.

The filing system taught by Grundell, '374, has the disadvantage of drilling a hole through the sheet material for the button fastener. This is time-consuming and also destroys the integrity of the sheet material which may be undesirable. Additionally, the ability to roll the sheet material onto the clip is difficult.

Lastly, the Broek patent, '966, has difficulties similar to those encountered in the binder clip vertical filing systems. The amount of tension is determined by the binder strip 31. This cannot be adjusted, and therefore the user is left with a single biasing force. Unlike the binder clip, there is no easy way to separate the legs of the binder strip 31 to insert sheets of material or coupling means 112.

SUMMARY OF THE INVENTION

The present invention overcomes the above disadvantages by providing an inexpensive easy to use vertical filing system for storing sheets of material, as for example blueprints, in a vertical or hanging position and for providing an easy way to transport the sheet material when it is to be used.

The system has a clip means, which in the preferred embodiment is a somewhat tubular-shaped member, open along its longitudinal extent. The walls of the clip which define the opening are normally biased outwardly with respect to one another to facilitate the insertion of sheet material. This longitudinal opening can be enlarged by urging the walls of the clip outwardly permitting greater amounts of sheet material to be inserted into the opening.

In the preferred embodiment, the clip has a cross-sectional configuration which defines a biasing portion, a body portion and a clamping portion. The biasing portion has a wall thickness which is less than the wall thickness of the body Portion. This allows the walls of the tube to be more easily spread apart. The clamping portion is formed at the free edges of the body portion and is configured to grip the sheet material and hold it in place. The clamping portion has a gripping means for gripping the sheets and a locking means opposite the gripping means for locking the gripping means.

The locking means interacts with a retaining means to lock the gripping means against the sheet material. In the preferred embodiment the locking means has teeth or notches which are configured to receive the free edges of the retaining means to facilitate the interaction between the locking means and the clip and to permit adjustment of the clip so that material of various thickness can be clipped. Adjustment is accomplished by engaging the various sets of teeth with the free edges of the retaining means.

Preferably, the locking means is an elongated tube which has an opening along its longitudinal extent defined by the free edges of the tube. In the preferred embodiment, the opening in this tube is narrower than the outside dimension of the clamping portion so that it squeezes the clamping portion when the clip is inserted. This enhances the retaining force applied to the sheets.

A second tube is provided which is also open along its longitudinal extent and is adapted to receive the clip and first tube. The first tube can be inserted into the second tube and the sheet of material can hang from the clip and first tube through the longitudinal opening in the second tube. The second tube is mounted to a support rack so that the sheet material can hang vertically.

The tubes can be made of various materials. As for example, all of the tubes could be made of plastic or the clip can be made of plastic and the tubes made of aluminum, etc. The only requirement in selecting the material is that the clip must have a resilient biasing region so that the walls of the tube can be sufficiently separated to receive the sheets to be held without plastic deformation. In the preferred embodiment, the clip and tubes are made of plastic, such as polyvinyl chloride. It should be understood that the invention is not intended to be limited to the specific material except as specifically set forth in the claims of this application.

In use, the vertical filing system of this invention provides an efficient, inexpensive method of filing and transporting. The sheets of material are inserted into the clip which is then inserted into the retaining tube. The location of the facing edges of the retaining tube with respect to the locking teeth of the clip will be determined by the thickness of the sheets being clipped. Due to the narrower opening of the retaining tube as compared to the width of the clip, the clip will squeeze the sheets of material holding them in place.

Once the sheets are secured, the retaining tube and clip can be inserted into the mounting tube. The mounting tube is connected to the support frame which can be of standard construction. When the sheets of material are needed, the retaining tube can be slid out of the mounting tube and the sheets of material easily rolled upon the mounting tube for easy transportation.

DETAILED DESCRIPTION OF THE INVENTION

Figure 1:
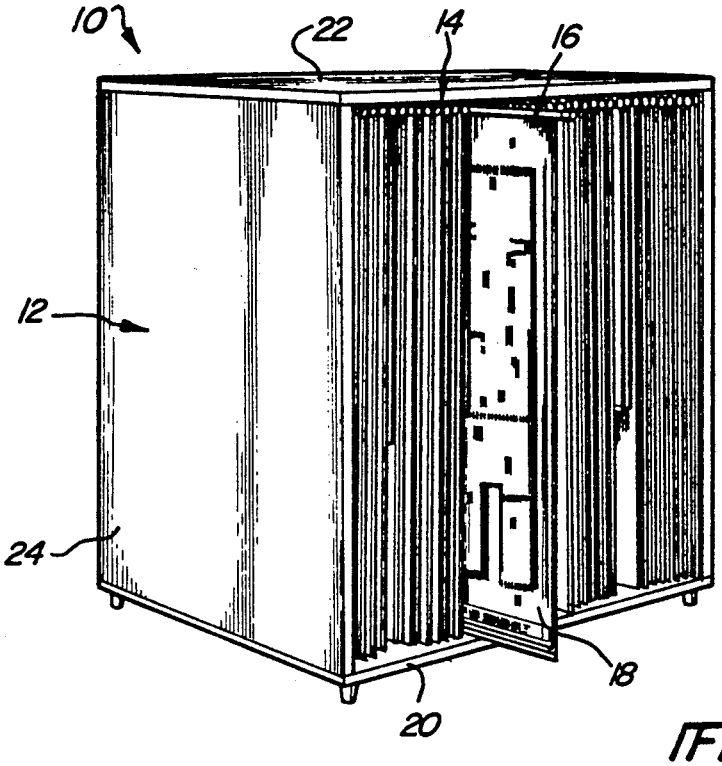
FIG. 1 is a perspective view of the vertical filing system of the present invention.

With reference to FIG. 1, the vertical filing system of the present invention is shown generally at 10. System 10 includes a support frame 12, mounting means 14 and sheet clamping means 16 for clamping sheets of material shown generally at 18.

The support frame 12 includes a base 20, a top rack 22 and vertical supports 24. It should be appreciated that this is merely an example of a support frame, and any other type of support frame could be used with the vertical filing system of the present invention, and the invention is not intended to be limited by the support frame illustrated.

Mounting means 14 are mounted to the top racks 22 of support frame 12 by connectors 30. These connectors 30 can be of any conventional type. For example, the connector 30 could include a threaded stud extending upwardly from mounting means 14 through top rack 22 to which a nut can be attached. Additionally, mounting means 14 could have a slotted top portion into which connector 30 is received. Connector 30 would then have a short shaft and a locking foot at its free end to be received within the slot formed in the top of mounting means 14. As should be appreciated, numerous other mounting means are available and would be acceptable for fastening the mounting means 14 to the top rack 22 of support frame 12.

Mounting means 14 is made from an elongated tubular member having an opening along its longitudinal extent. As disclosed, the tubular member is round; however, it is within the scope of this invention that the tubular member could be square, triangular, etc. Mounted within mounting means 14 is the sheet clamp means 16. This can best be seen in FIG. 2. Therefore, it is important that the mounting means have an inside diameter which is greater than the outside diameter of sheet clamping means 16 so that sheet clamping means 16 can easily be inserted into mounting means 14. In the preferred embodiment, mounting means 14 is made from extruded plastic, such as for example polyvinyl chloride. The mounting tube could also be made of metal if a more polished look is desired. The only criterion for the mounting tube is that it be a rigid tube capable of supporting the sheet clamping means and clamped sheets.

Figure 2:
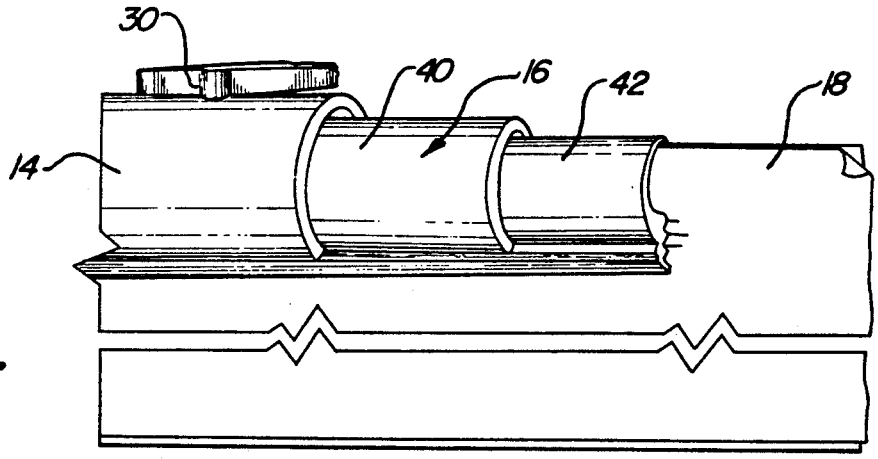
FIG. 2 is a partial perspective view of the retaining tube and sheet clamping means of the present invention.
Figure 3:
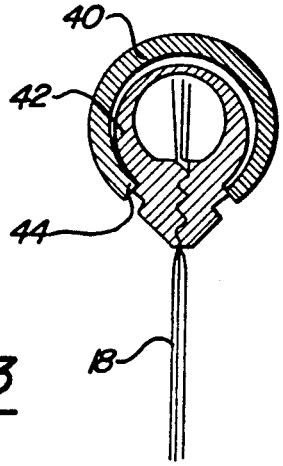
FIG. 3 is a cross-sectional view of the sheet clamping means clamping a small amount of sheet material.
Figure 4:
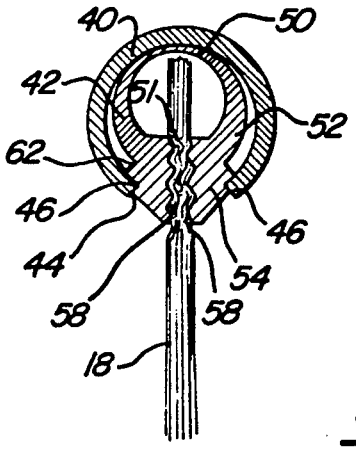
FIG. 4 is a cross-sectional view of the sheet clamping means clamping a large amount of sheet material.

The sheet clamping means 16 is shown in FIGS. 2–4. Clamping means 16 includes a retaining means 40 and a clip means 42. Retaining means 40 is disclosed as having an elongated tubular shape with a longitudinally extending opening. This opening is defined by the facing edges 46 of retaining means 40. In the preferred embodiment, retaining means 40 is round in cross-section and made of plastic, such as for example polyvinyl chloride. Other shapes and materials could be used. The outside diameter of retaining means 40 is less than the inside diameter of mounting means 14. The inside diameter of retaining means 40 must be sufficiently wide to receive the clip means 42 as illustrated in FIG. 2.

The clip means 42 is a somewhat tubular-shaped member formed of plastic, such as for example polyvinyl chloride or other stiff, resilient material, with a longitudinally extending opening. The cross-section of clip 42 defines a resilient portion 50 which is opposite the longitudinally extending opening, a body portion 52 and a clamping portion 54. The resilient portion 50 has a wall thickness which is substantially less than the wall thickness of body portion 52. This facilitates enlarging opening 51 when sheets of material are to be inserted into it. Additionally, the relative wall thickness normally urges the clamping portion 54 apart to widen the longitudinal opening 51 so that material can be easily inserted.

The clamping portion 54 has facing friction surfaces 58 and locking means 60 opposite the friction surfaces. In the disclosed embodiment, the locking means 60 are a series of teeth or notches formed in the outer surface of the clamping portion 54. The locking means receives the edges 46 of retaIning means 40 to urge the friction surface 58 of clamping portion 54 together, gripping the material to be hung therebetween. A plurality of teeth 62 is provided for gripping different amounts of sheet material. As shown in FIG. 3, the upper notches 62 are engaged by the edges 46 of retaining means 40 so that the friction surfaces are forced closer together to hold smaller amounts of material. In FIG. 4, the second or lower set of notches is engaged by the edges 46 of retaining means 40 so that the frictional surfaces 58 are not as close together so that larger amounts of sheet material can be retained. By engaging one lower and one upper notch, an intermediate amount of sheet material could be gripped. As should be understood, further notches can be provided if additional amounts of sheet material are intended to be retained.

In operation, the clip means 42 is mounted over the edge of sheet material 18. As explained above, the clip means will normally be open a sufficient amount so that the sheet material can be easily inserted between friction surfaces 58. This is due to the wall thickness relationship between the resilient portion 50 and body portion 52. Once the sheet material 18 is inserted into clip means 42, clip means 42 is inserted into the retaining means so that the edges 46 engage the appropriate notches 62. The retaining means 40 has a consistent wall thickness which is sufficient to resist widening of opening 44. Due to this, the clamping portion 54 of clip 42 is forced inwardly to squeeze the sheet material as clip means 42 is inserted into retaining means 40. Once inserted, the retaining and clip means form sheet clamp means 16 which can then be inserted into mounting means 14.

In order to facilitate location of the appropriate sheet material, identification labels 80 can be employed which are attached to the end of mounting means 14.

As should be appreciated, a preferred embodiment of the above invention has been illustrated and described. As will be apparent to one of ordinary skill in the art, certain modifications to the above embodiment may be made. For example, the resilient portion 50 of clip means 42 could be straps connecting the opposed body portions 52 as opposed to being the upper portion of an extruded tube. Additionally, the biasing and wall portion could be of generally equal thickness. As will be apparent to those skilled in the art, other modifications can be made and still be within the scope of the claimed invention.

I claim:

1. A holding assembly for holding sheets of material, said holding assembly comprising:

a clip means open along its longitudinal extent, said clip means having a cross sectional configuration defining a biasing portion, a body portion, and a clamping portion, said biasing and body portions having relative wall thickness with the wall thickness of the biasing portion being less than the wall thickness of the body portion such that the longitudinal opening in the clip means can be enlarged by urging the walls of said body portion outwardly;

said clamping portion having a gripping means thereon for gripping sheet material and a locking means opposite said gripping means for use in locking said clamping portion against said sheet to ensure that said sheet is properly retained;

a first elongated tubular member open along its longitudinal extent and adapted to receive said clip means, said first tubular member being adapted to engage said locking means and force said gripping means into engagement with said sheet such that said sheet is retained within said gripping means;

a second tubular member open along its longitudinal extent and adapted to receive said clip means and first tubular member; and a support rack to which said second tubular member is mounted and from which said clip means and first tubular member are supported and from which said sheets are adapted to be vertically stored.

2. The holding assembly of claim 1, wherein said opening of said first tubular defines longitudinal free edges of said first tubular member with said free edges being spaced apart a distance sufficient to receive said gripping portion such that said gripping portion grasps and retains said sheets therebetween.

3. The holding assembly of claim 1, wherein said gripping means has a friction surface for gripping said sheets.

4. The holding assembly of claim 1, wherein said gripping means has a serrated surface.

5. The holding assembly of claim 2, wherein said clamping portion has teeth thereon configured to receive said free edges of said first tubular member.

6. The holding assembly of claim 1, wherein said clip means and first and second tubular members are formed of polyvinyl chloride.

7. The holding assembly of claim 1, wherein said clip means and tubular members are formed of extruded plastic.

8. A holding assembly for holding sheets of material, said holding assembly comprising:

a clip means open along its longitudinal extent, said clip means having a clamping portion for engaging said sheets of material;

said clamping portion having a gripping means thereon for gripping a sheet of material therebetween;

a retaining means open along its longitudinal extent defining free edges, said clip means having teeth thereon configured to receive said free edges of said retaining means, said teeth permitting adjustment of said clip means opening for various widths of material;

a tubular member open along its longitudinal extent and adapted to receive said clip and retaining means such that said retaining means can be inserted into said tubular member and said sheet of material can hang from said clip means through said longitudinal opening in said tubular member;

a support rack to which said tubular member is mounted and from which said clip and retaining means are supported and from which said sheets are adapted to be vertically stored.

9. The holding assembly of claim 8, wherein said clamping portion has a locking means opposite said gripping means with said retaining means adapted to engage said locking means and force said gripping means into engagement with said sheet such that said sheet is squeezed between said gripping means.

10. The holding assembly of claim 8, wherein said retaining means is a tubular shaped member and said opening in said retaining means is defined by the free edges of said tubular shaped member with said free edges being spaced apart a distance sufficient to receive said gripping portion and exert an inward bias to said gripping portion such that said gripping portion grasps and retains said sheets therebetween.

11. The holding assembly of claim 8, wherein said gripping means has a friction surface for gripping said sheets.

12. The holding of claim 8, wherein said clip and retaining means and said tubular member are formed of polyvinyl chloride.

13. The holding assembly of claim 8, wherein said clip and retaining means and tubular member are formed of extruded plastic.

14. A holding assembly for holding sheets of material, said holding assembly comprising:

a first elongated tubular member open along its longitudinal extent, said first tubular member having a cross sectional configuration defining a biasing portion, a body portion, and a clamping portion, said biasing and body Portions having relative wall thickness with said wall thickness of said biasing portion being less than said wall thickness of said body portion such that said longitudinal opening in said first tubular member can be enlarged by urging the walls of said body portion outwardly by applying a force thereto for receipt of sheets of material;

said clamping portion having a gripping means for gripping said sheets and a locking means opposite said gripping means for use in locking said clamping portion against said sheets to ensure that said sheets are properly retained;

a second elongated tubular member open along its longitudinal extent and adapted to receive said first tubular member, said second tubular member being adapted to engage said clamping portion and force said gripping means into engagement with said sheets such that said sheets are retained within said gripping means, said opening of said second tubular member being defined by said free edges with said free edges being spaced apart a distance sufficient to receive said gripping portion such that said gripping portion grasps and retains said sheets;

a third tubular member open along its longitudinal extent and adapted to receive said first and second tubular members; and a support rack to which said third tubular member is mounted and from which said first and second tubular members are supported and from which said sheets are adapted to be vertically stored.

15. The holding assembly of claim 14, wherein said gripping means has a friction surface for gripping said sheets.

16. The holding assembly of claim 14, wherein said gripping means has a serrated surface.

17. The holding assembly of claim 14, wherein said clamping portion has teeth thereon configured to receive said free edges of said second tubular member.

18. The holding assembly of claim 14, wherein at least said first tubular member is formed of polyvinyl chloride.

19. The holding assembly of claim 14, wherein said tubular member are formed of extruded plastic.

* * * * *